US006018501A

United States Patent [19]

Smith et al.

[11] Patent Number: 6,018,501

[45] Date of Patent: Jan. 25, 2000

[54] SUBSEA REPEATER AND METHOD FOR USE OF THE SAME

[75] Inventors: Harrison C. Smith, Anna; Paul D. Ringgenberg, Carrollton, both of Tex.

[73] Assignee: Halliburton Energy Services, Inc., Dallas, Tex.

[21] Appl. No.: 08/987,991

[22] Filed: Dec. 10, 1997

[51] Int. Cl.[7] ..... H04V 9/00; H04B 11/00

[52] U.S. Cl. ..... 367/134; 367/81

[58] Field of Search ..... 367/134, 15, 83, 367/133, 81; 375/218

[56] References Cited

U.S. PATENT DOCUMENTS

| | | | |
|---|---|---|---|
| 2,379,800 | 7/1945 | Hare | 175/356 |
| 2,411,696 | 11/1946 | Silverman et al. | 177/352 |
| 3,186,222 | 6/1965 | Martin | 73/151 |
| 3,205,477 | 9/1965 | Kalbfell | 340/18 |
| 3,227,228 | 1/1966 | Bannister | 175/4 |
| 3,233,674 | 2/1966 | Leutwyler | 166/63 |
| 3,333,239 | 7/1967 | Silverman | 340/18 |
| 3,717,844 | 2/1973 | Barret et al. | 375/218 |
| 3,930,220 | 12/1975 | Shawhan | 340/18 FM |
| 4,019,148 | 4/1977 | Shawhan | 328/167 |
| 4,087,781 | 5/1978 | Grossi et al. | 340/18 NC |
| 4,147,222 | 4/1979 | Patten et al. | 175/9 |
| 4,161,715 | 7/1979 | Harris | 340/16 |
| 4,181,014 | 1/1980 | Zuvela et al. | 73/151 |
| 4,215,426 | 7/1980 | Klatt | 367/83 |
| 4,293,936 | 10/1981 | Cox et al. | 367/82 |
| 4,293,937 | 10/1981 | Sharp et al. | 367/82 |
| 4,298,970 | 11/1981 | Shawhan et al. | 367/82 |
| 4,302,757 | 11/1981 | Still | 340/854 |
| 4,309,763 | 1/1982 | Passmore et al. | 367/3 |
| 4,320,473 | 3/1982 | Smither et al. | 367/82 |
| 4,348,672 | 9/1982 | Givier | 340/854 |
| 4,363,137 | 12/1982 | Salisbury | 455/40 |
| 4,373,582 | 2/1983 | Bednar et al. | 166/65 R |
| 4,387,372 | 6/1983 | Smith et al. | 340/854 |
| 4,406,919 | 9/1983 | Pospischil | 178/69 G |
| 4,428,073 | 1/1984 | Verburgt | 367/134 |
| 4,468,665 | 8/1984 | Thawley et al. | 340/856 |
| 4,496,174 | 1/1985 | McDonald et al. | 285/53 |
| 4,525,715 | 6/1985 | Smith | 340/854 |
| 4,562,559 | 12/1985 | Sharp et al. | 367/82 |
| 4,578,675 | 3/1986 | MacLeod | 340/855 |
| 4,599,745 | 7/1986 | Baran et al. | 455/612 |
| 4,616,702 | 10/1986 | Hanson et al. | 166/65.1 |
| 4,617,960 | 10/1986 | More | 137/554 |
| 4,684,946 | 8/1987 | Issenmann | 340/855 |
| 4,691,203 | 9/1987 | Rubin et al. | 340/856 |
| 4,698,631 | 10/1987 | Kelly, Jr. et al. | 340/853 |
| 4,725,837 | 2/1988 | Rubin | 340/855 |
| 4,739,325 | 4/1988 | MacLeod | 340/854 |
| 4,757,157 | 7/1988 | Pelet | 174/50 |
| 4,766,442 | 8/1988 | Issenmann | 343/719 |
| 4,788,544 | 11/1988 | Howard | 340/853 |
| 4,800,570 | 1/1989 | Perrotta et al. | 375/4 |
| 4,828,051 | 5/1989 | Titchener et al. | 175/50 |
| 4,839,644 | 6/1989 | Safinya et al. | 340/854 |
| 4,845,493 | 7/1989 | Howard | 340/853 |
| 4,901,069 | 2/1990 | Veneruso | 340/853 |
| 4,908,804 | 3/1990 | Rorden | 367/81 |
| 4,933,640 | 6/1990 | Kuckes | 324/339 |
| 4,968,978 | 11/1990 | Stolarczyk | 340/854 |
| 5,029,147 | 7/1991 | Andrews et al. | 367/134 |
| 5,047,990 | 9/1991 | Gafos et al. | 367/6 |
| 5,087,099 | 2/1992 | Stolarczyk | 299/1 |
| 5,119,500 | 6/1992 | Bickel | 455/15 |
| 5,130,706 | 7/1992 | Van Steenwyk | 340/854.6 |
| 5,160,925 | 11/1992 | Dailey et al. | 340/853.3 |
| 5,268,683 | 12/1993 | Stolarczyk | 340/854.4 |
| 5,319,376 | 6/1994 | Eninger | 342/357 |
| 5,379,034 | 1/1995 | O'Connell | 340/850 |
| 5,394,141 | 2/1995 | Soulier | 340/854.4 |
| 5,396,232 | 3/1995 | Mathieu et al. | 340/854.5 |
| 5,448,227 | 9/1995 | Orban et al. | 340/854.4 |
| 5,452,262 | 9/1995 | Hagerty | 367/6 |
| 5,467,083 | 11/1995 | McDonald et al. | 340/854.6 |
| 5,467,832 | 11/1995 | Orban et al. | 175/45 |
| 5,493,288 | 2/1996 | Henneuse | 340/854.4 |
| 5,530,358 | 6/1996 | Wisler et al. | 324/338 |
| 5,576,703 | 11/1996 | MacLeod et al. | 340/854.4 |
| 5,579,285 | 11/1996 | Hubert | 367/133 |
| 5,583,504 | 12/1996 | Huggett | 342/15 |
| 5,691,712 | 11/1997 | Meek et al. | 340/853.3 |

FOREIGN PATENT DOCUMENTS

| | | |
|---|---|---|
| 0 636 763 A2 | 7/1994 | European Pat. Off. . |
| 94305423 | 7/1994 | European Pat. Off. . |
| 0 672 819 A2 | 9/1995 | Norway . |
| 2 281 424 | 1/1996 | United Kingdom . |

*Primary Examiner*—Daniel T. Pihulic
*Attorney, Agent, or Firm*—Paul I. Herman; Lawrence R. Youst

[57] ABSTRACT

A subsea repeater apparatus (48) for communicating information between surface equipment (60) and downhole equipment (44) is disclosed. The apparatus (48) comprises an electromagnetic receiver (66, 68) that receives an electromagnetic signal (46) carrying information from downhole equipment (44) and an acoustic modem (54) that acoustically retransmits (56) the information to surface equipment (60) through the sea. The apparatus (48) may also comprise an acoustic modem (54) that receives an acoustic signal (64) carrying information from surface equipment (60) through the sea and an electromagnetic transmitter (50) that radiates electromagnetic waves (66) carrying the information into the earth.

35 Claims, 3 Drawing Sheets

SUBSEA REPEATER AND METHOD FOR USE OF THE SAME

TECHNICAL FIELD OF THE INVENTION

This invention relates in general to downhole telemetry and, in particular to, an apparatus and method for telemetry of information between surface equipment and downhole equipment through the sea and vice versa.

BACKGROUND OF THE INVENTION

Without limiting the scope of the present invention, its background is described in connection with transmitting downhole data to the surface during measurements while drilling (MWD), as an example. It should be noted that the principles of the present invention are applicable not only during drilling, but throughout the life of a wellbore including, but not limited to, during logging, testing, completing and producing the well.

Heretofore, in this field, a variety of communication and transmission techniques have been attempted to provide real time data from the vicinity of the bit to the surface during drilling. The utilization of MWD with real time data transmission provides substantial benefits during a drilling operation. For example, continuous monitoring of downhole conditions allows for an immediate response to potential well control problems and improves mud programs.

Measurement of parameters such as bit weight, torque, wear and bearing condition in real time provides for a more efficient drilling operation. In fact, faster penetration rates, better trip planning, reduced equipment failures, fewer delays for directional surveys, and the elimination of a need to interrupt drilling for abnormal pressure detection is achievable using MWD techniques.

At present, there are four major categories of telemetry systems that have been used in an attempt to provide real time data from the vicinity of the drill bit to the surface, namely mud pressure pulses, insulated conductors, acoustics and electromagnetic waves.

In a mud pressure pulse system, the resistance of mud flow through a drill string is modulated by means of a valve and control mechanism mounted in a special drill collar near the bit. This type of system typically transmits at 1 bit per second as the pressure pulse travels up the mud column at or near the velocity of sound in the mud. It has been found, however, that the rate of transmission of measurements is relatively slow due to pulse spreading, modulation rate limitations, and other disruptive limitations such as the requirement of mud flow.

Insulated conductors, or hard wire connection from the bit to the surface, is an alternative method for establishing downhole communications. This type of system is capable of a high data rate and two way communication is possible. It has been found, however, that this type of system requires a special drill pipe and special tool joint connectors which substantially increase the cost of a drilling operation. Also, these systems are prone to failure as a result of the abrasive conditions of the mud system and the wear caused by the rotation of the drill string.

Acoustic systems have provided a third alternative. Typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission.

The fourth technique used to telemeter downhole data to the surface uses the transmission of electromagnetic waves through the earth. A current carrying downhole data is input to a toroid or collar positioned adjacent to the drill bit or input directly to the drill string. An electromagnetic receiver is inserted into the ground at the surface where the electromagnetic data is picked up and recorded. It has been found, however, that in offshore applications, the boundary between the sea and the sea floor has a nonuniform and unexpected electrical discontinuity. Conventional electromagnetic systems are, therefore, unable to effectively pickup or receive the electromagnetic signals at the boundary between the sea and the sea floor. Additionally, it has been found that conventional electromagnetic systems are unable to effectively transmit the electromagnetic signals through sea water due to the conductivity of sea water and the boundary layer between the sea and air.

Therefore, a need has arisen for a system that is capable of telemetering real time data from the vicinity of the drill bit in a deep or noisy well using electromagnetic waves to carry the information to the sea floor. A need has also arisen for an apparatus that is capable receiving an electromagnetic signal carrying information at the sea floor and retransmitting the information to the surface through the sea.

SUMMARY OF THE INVENTION

The present invention disclosed herein comprises a subsea repeater that receives and retransmits information between downhole equipment and surface equipment. The subsea repeater of the present invention provides for real time communication between downhole equipment and surface equipment using electromagnetic waves to carry the information through the earth and acoustic waves to carry information through the sea.

The subsea repeater of the present invention comprises an electromagnetic receiver that receives an electromagnetic signal carrying information that may be generated by a downhole device. The information may include drilling parameters such as bit weight, torque, wear and bearing or may include reservoir parameters such as pressure, temperature, porosity, and resistivity as well as distribution, saturation, depletion and movement of oil, gas and water. In addition, the information may include operating parameters of downhole equipment such as the position or orientation of packers, sleeves and valves.

The electromagnetic receiver may include an H-field probe having an end that is insertable into the earth and at least one E-field probe having an end that is insertable into the earth such that the subsea repeater may pick up the H-field component or the E-field component of the electromagnetic signal or both. The electromagnetic receiver transforms the electromagnetic signal carrying information into an electrical signal that is fed to an electronics package for processing and storing the information.

After a specified period of time, such as once an hour during a drilling operation or once a day during a production operation, the information stored in the electronics package is forwarded to an acoustic transmitter. The acoustic transmitter transforms the electrical signal into an acoustic signal that retransmits the information to the surface, through the sea. The acoustic transmitter may transmit the information using, for example, frequency shift keying or multiple frequency shift keying.

The subsea repeater of the present invention may also include an acoustic receiver that receives an acoustic signal carrying information that may be generated by a surface device and transmitted through the sea. The information may include commands to obtain the aforementioned drilling, reservoir or operating parameters or may include commands to change the operation state of a downhole device.

The acoustic receiver transforms the acoustic signal into an electrical signal that is fed to the electronics package for processing and storing the information. The information stored in the electronics package is then forwarded to an electromagnetic transmitter that transforms the electrical signal into an electromagnetic signal that is radiated into the earth and is pickup by a downhole device.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
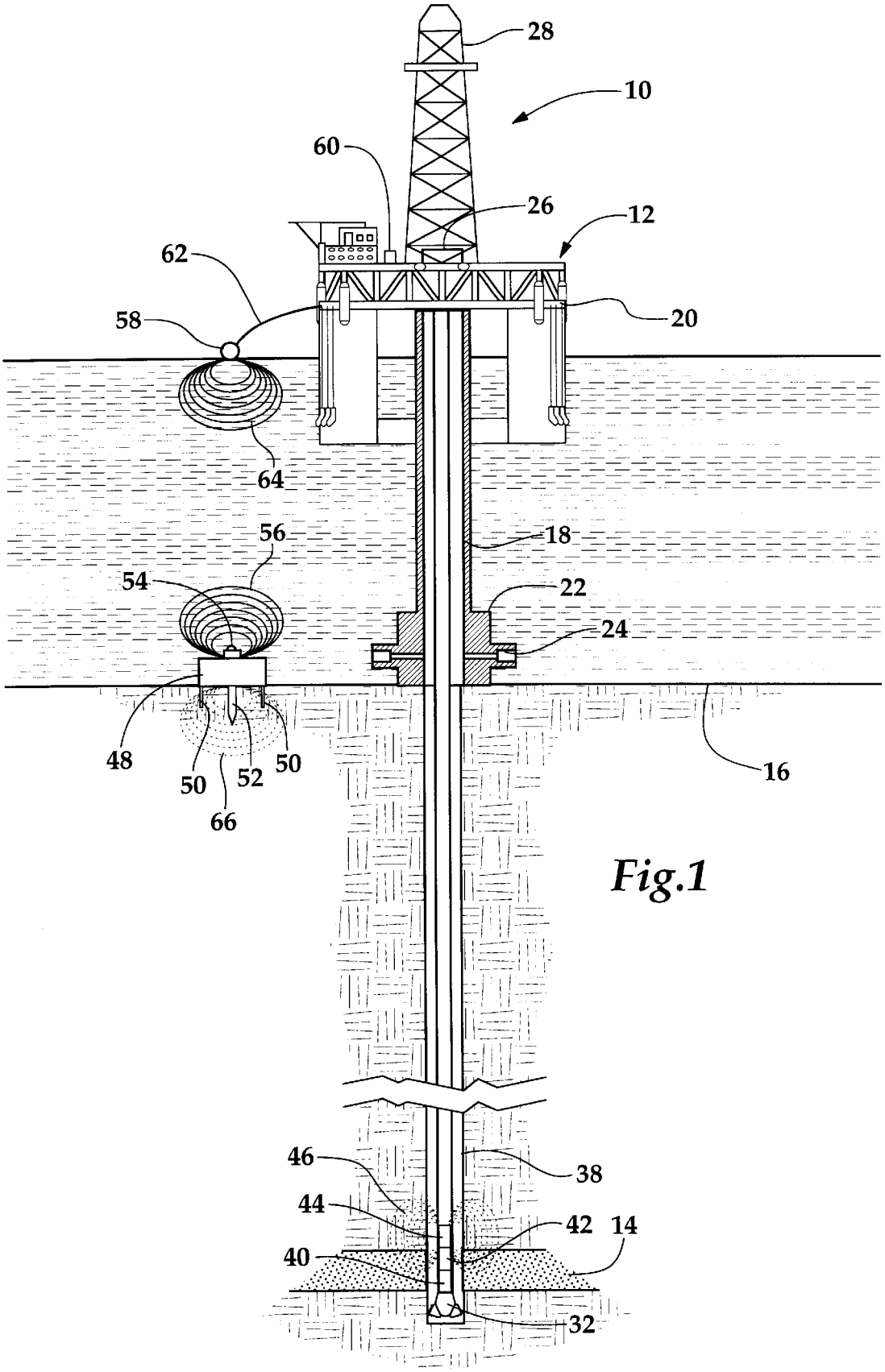
FIG. 1 is a schematic illustration of an offshore oil or gas drilling platform operating a subsea repeater of the present invention.

Referring to FIG. 1, a subsea repeater in use during an offshore drilling operation is schematically illustrated and generally designated 10. A semi-submergible platform 12 is centered over a submerged oil and gas formation 14 located below sea floor 16. A subsea conduit 18 extends from deck 20 of platform 12 to a wellhead installation 22 including blowout preventers 24. Platform 12 has a hoisting apparatus 26 and a derrick 28 for raising and lowering drill string 30, including drill bit 32.

In a typical drilling operation, drill bit 32 is rotated by drill string 30, such that drill bit 32 penetrates through the various earth strata, forming wellbore 38. Measurement of parameters such as bit weight, torque, wear and bearing conditions of drill bit 32 may be obtained by sensors 40 located in the vicinity of drill bit 32. Additionally, parameters such as pressure and temperature as well as a variety of other environmental and formation information may be obtained by sensors 40. The signal generated by sensors 40 may typically be in the form of pulse width data, or the like, which must be converted to digital data before electromagnetic transmission in the present system. The signal generated by sensors 40 is passed into an electronics package 42 including an analog to digital converter which converts the analog signal to a digital code utilizing 1's and 0's for information transmission.

Electronics package 42 may also include electronic devices such as an on/off control, a modulator, a microprocessor, memory and amplifiers. Electronics package 42 is powered by a battery pack which may include a plurality of nickel cadmium or lithium batteries which are configured to provide proper operating voltage and current.

Once the electronics package 42 establishes the frequency, power and phase output of the information, electronics package 42 feeds the information to transmitter 44. Transmitter 44 may be a direct connect type transmitter that utilizes an output voltage applied between two electrical terminals that are electrically isolated from one another to generate electromagnetic wave fronts 46. Electromagnetic wave fronts 46 radiate into the earth carrying the information obtained by sensors 40.

Alternatively, transmitter 44 may include a magnetically permeable annular core, a plurality of primary electrical conductor windings and a plurality of secondary electrical conductor windings which are wrapped around the annular core. Collectively, the annular core, the primary windings and the secondary windings serve to approximate an electrical transformer which generates electromagnetic wave fronts 46.

Electromagnetic wave fronts 46 travel through the earth and are received by subsea repeater 48 located on sea floor 16. Subsea repeater 48 may detect either the electrical field (E-field) component of electromagnetic wave fronts 46, the magnetic field (H-field) component of electromagnetic wave fronts 46 or both using E-field probes 50 and H-field probe 52 or both. As electromagnetic wave fronts 46 reach subsea repeater 48, a current is induced in subsea repeater 48 that carries the information originally obtained by sensors 40. The current is fed to an electronics package within subsea repeater 48 that may include a variety of electronic devices such as a preamplifier, a limiter, filters, shift registers, comparators and amplifiers as will be further discussed with reference to FIG. 3. The electronics package cleans up and amplifies the signal to reconstruct the original waveform, compensating for losses and distortion occurring during the transmission of electromagnetic wave fronts 46 through the earth.

The electronics package may include a comparator for comparing the relative strength and clarity of the H-field component versus the E-field component of electromagnetic wave fronts 46. The electronics package may then select the stronger of the two signals for retransmission. Alternatively, the two signals may be electronically filtered and combined to produce a hybrid signal for retransmission. Also, it should be noted that the H-field component and the E-field component of electromagnetic wave fronts 46 received by subsea repeater 48 may be compared to 1s determined whether both signals contain the identical information as a check of the validity of the transmitted data.

After the electrical signal has been processed, it may be forwarded to acoustic modem 54 that will transform the electrical signal into acoustic waves 56. Alternatively, the information originally obtained by sensors 40 may be stored in memory in subsea repeater 48 for a predetermined period of time prior to forwarding the electrical signal to acoustic modem 54. For example, in the drilling operation as depicted in FIG. 1, the information may be transmitted from acoustic modem 54 on a periodic basis such as every hour. In a production operation, however, the information may be stored in the memory of subsea repeater 48 for twelve hours or twenty-four hours or even longer prior to transmission by acoustic modem 54. Thus, as should be apparent to those skilled in the art, that the length of time between transmissions from acoustic modem 54 will depend upon the amount of information transmitted from sensors 40 and the amount of memory available in subsea repeater 48. In addition, it should be noted that subsea repeater 48 may simply process and forward the information that is received without storing the information in memory.

The information may be encoded into acoustic waves 56 by acoustic modem 54 using, for example, frequency shift keying (FSK) or multiple frequency shift keying (MFSK). Using FSK, acoustic modem 54 converts the electrical signal from a digital format into an analog format by representing the digital values with different frequencies within a defined range. Using the FSK technique, the 0's and 1's of the digital information are represented by discreet frequency pulses using frequency f1 for the 0's and frequency f2 for the 1's. Each frequency pulse, f1 or f2, represents one data bit. Using FSK may provide reliable data transmission through the sea in the range of 40 baud. The data transfer rate is limited by transmission of only one bit at a time along with the need to have intervals between transmissions to eliminate ambiguities caused by the hostile sea environment.

Alternatively, acoustic modem 54 may transmit data using MFSK. MFSK modulation improves the data transmission rate by simultaneously broadcasting multiple data bytes. MFSK utilizes a group of four frequencies to represent the first two bits of the first byte. The next higher group of frequencies is used for the next two positions. By transmitting more than one data bit simultaneously, the data transfer rate is dramatically increased. For example, in an application using the FSK technique to provide reliable transmission of data at 40 baud, using the MFSK technique would achieve reliable transmission of data at 1,200 baud, allowing data collection to be accomplished in 1/30th of the time it would take with FSK. Additionally, when the conditions of the sea are such that high error rates are occurring, the MFSK technique can be used to transmit two copies of each data bit so that surface installation 60 may perform error detection and correction while having data transferred at, for example, 600 baud.

Thus, using FSK, MFSK or similar technique, acoustic waves 56 are transmitted through the sea carrying the information originally obtained by sensors 40. Acoustic waves 56 are then picked up by acoustic modem 58 and forwarded to surface installation 60 via electric wire 62. Surface installation 60 may include a computer system that processes, stores and displays the information originally obtained by sensors 40. Surface installation 60 may include a peripheral computer or work station with a processor, memory and audio visual capabilities. Surface installation 60 includes a power source for producing the necessary energy to operate surface installation 60 and may also provide the power necessary to operate acoustic modem 58. Electric wire 62 may be connected to surface installation 60 using an RS-232 interface.

Subsea repeater 58 of the present invention may also be used as a downlink to communicate information from surface installation 60 to a downhole device. For example, during a production operation, surface installation 60 may be used to request downhole pressure, temperature or flow rate information from formation 14 by sending acoustic waves 64 through the sea from acoustic modem 58. Acoustic waves 64 will be received at subsea repeater 48 by acoustic modem 54. Acoustic waves 64 may use FSK or MFSK as described above to carry the information. Acoustic modem 54 will transform acoustic waves 64 into an electrical signal that is passed on to the electronics package of subsea repeater 48 and processed as described above. Subsea repeater 48 may then generate electromagnetic wave fronts 66 to retransmit the information originally generated by surface installation 60. Sensors, such as sensors 40, located near formation 14 receive this request and obtain the appropriate information which would then be returned to surface installation 60 via electromagnetic wave fronts 46 and acoustic waves 56 as described above.

Even though FIG. 1 has been described with reference to acoustic modem 58 in communication with surface installation 60 on platform 12, it should be noted by one skilled in the art that acoustic modem 58 is equally well-suited for receiving and transmitting acoustic waves such as acoustic waves 56, 64 from a remote well installation not associated with a production platform. For example, acoustic modem 58 may be attached to a ship or a crew boat that periodically travels to the remote well installation to request and obtain information relating to that remote well.

Additionally, it should be noted by one skilled in the art that subsea repeater 48 of the present invention is may be used in conjunction with downhole repeaters in deep or noisy well application wherein subsea repeater 48 may not be within the range of electromagnetic wave front 46.

Figure 2:
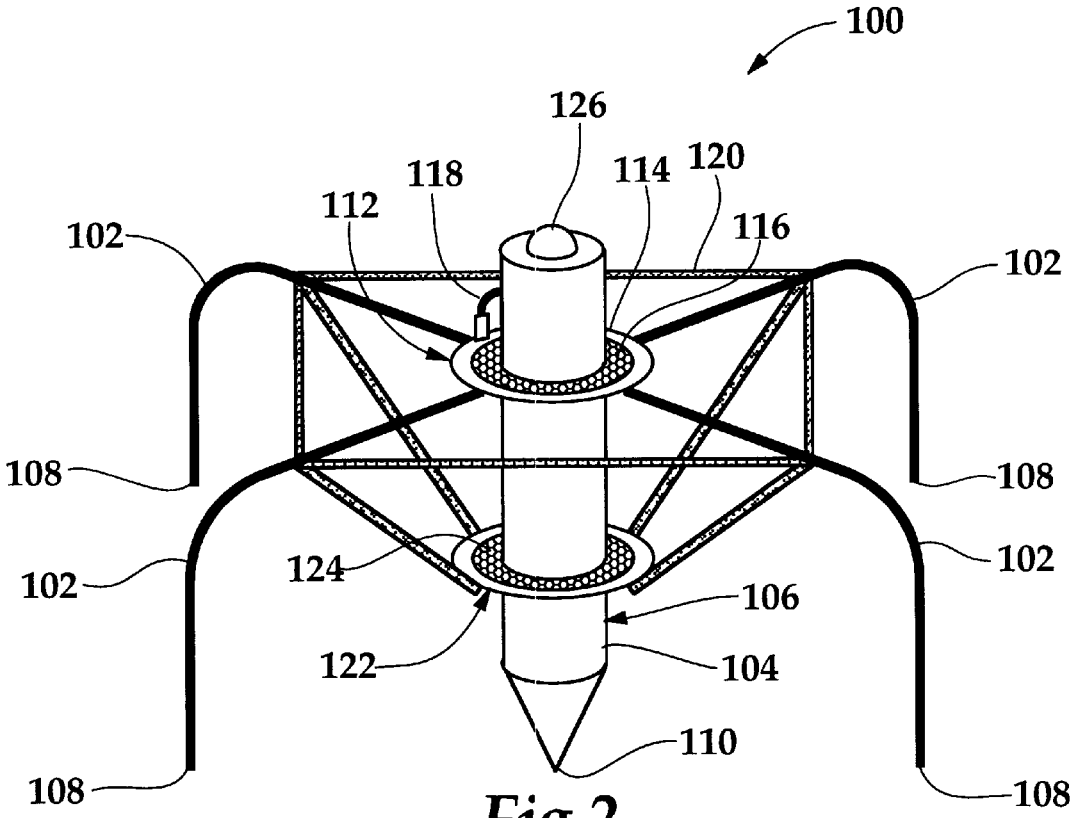
FIG. 2 is a schematic illustration of a subsea repeater of the present invention.

FIG. 2 is a perspective representation of subsea repeater 100 of the present invention. Subsea repeater 100 includes a plurality of E-field probes 102 and an H-field probe 104 disposed within housing 106. E-field probes 102 may be constructed from a conductive rod or tubing including metals such as steel, copper or a copper clad. E-field probes 102 each have an end 106 that inserted through sea floor 16 to extend into the earth such that electromagnetic wave fronts, such as electromagnetic wave fronts 46 of FIG. 1, may be received by E-field probes 102 without crossing the boundary between the sea and sea floor 16. E-field probes 102 pickup the E-field component of electromagnetic wave fronts 46.

H-field probe 104 of subsea repeater 100 has an end 108 that is inserted through sea floor 16 into the earth such that electromagnetic wave fronts 46 are received by H-field probe 104 before electromagnetic wave fronts 46 cross through the boundary of sea floor 16 and the sea. H-field probe 104 includes one or more magnetometers for detecting the H-field component of electromagnetic wave fronts 46.

Subsea repeater 100 includes an insulated ring 112 that attaches E-field probes 102 to housing 106. Insulated ring 84 includes an electrically conductive ring 114 and a dielectric ring 116. The electrically conductive ring 114 is attached to E-field probes 102 to provide an electrically conductive path between E-field probes 102 and an electronics package disposed within housing 106 via electrical cable 118 such that the information carried in the E-field component of electromagnetic wave fronts 46 may be process as will be discussed with reference to FIG. 3. Dielectric ring 116 creates a non-conductive region between no conductive ring 114 and housing 106.

Subsea repeater 100 may include an insulated cradle 120 that is disposed between E-field probes 102 and housing 106. Insulated cradle 120 provides structural support to E-field probes 102 to prevent relative translational or rotational motion between E-field probes 102 and housing 106. Insulated cradle 120 may be attached to housing 106 using an insulated ring 122 that may include a dielectric ring 124.

The E-field component of electromagnetic wave fronts 46 generates a current in E-field probes 102. The H-field component of electromagnetic wave fronts 46 generates a current in H-field probe 104. These two currents are passed on to the electronics package disposed within housing 106 as will be more fully described with reference to FIG. 3. The electronics package may include a comparator for comparing the relative strength and clarity of the H-field component and the E-field component of electromagnetic wave fronts 46. The electronics package may then select the stronger of the two signals for retransmission. Additionally, the electronics package may compare the H-field component and the E-field component of electromagnetic wave fronts 46 to determine whether both signals carry the identical information as a check of the validity of the transmitted data. After one or both of the electric signals are processed, the information may be stored by subsea repeater 100 in memory. While this information is retained in memory, additional electromagnetic wave fronts 46 carrying information may be received and stored by subsea repeater 100. At a predetermined time, the electronics package generates an electrical signal that is passed on to acoustic modem 126. Using FSK, MFSK or other suitable techniques, the information is then transmitted through the sea by acoustic modem 126.

Acoustic modem 126 may also receive acoustic signals, such as acoustic waves 64 of FIG. 1, when subsea repeater 100 serves as a downlink. Acoustic modem 126 transforms acoustic waves 64 into an electrical signal that is passed on to the electronics package disposed in housing 106. The electronics package processes the electrical signal as will be more fully described with reference to FIG. 3 below. After processing, the electronics package generates a current in one or more of the E-field probes 102 that in turn generates electromagnetic wave fronts 66 that propagate the information through the earth to a downhole location.

Figure 3:
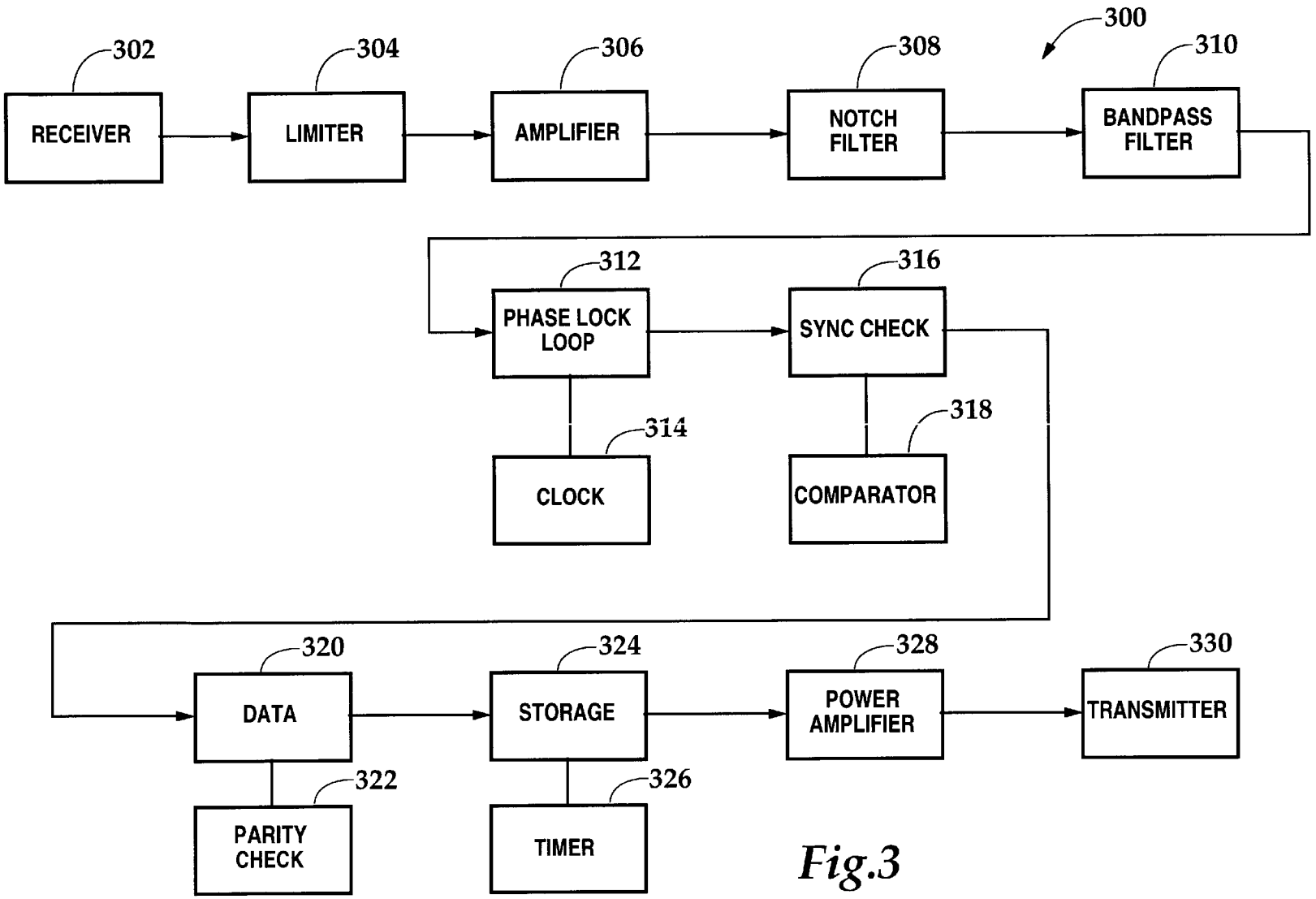
FIG. 3 is a block diagram of a signal processing method used by a subsea repeater of the present invention.

Turning now to FIG. 3, one embodiment of the method for processing the electrical signal within a subsea repeater 48 is described. Method 300 provides for digital processing of the information carried in the electrical signal that is generated by receiver 302 which may be an acoustic or an electromagnetic receiver such as acoustic modem 54, E-field probes 50 or H-field probe 52 of FIG. 1. Limiter 304 receives the electrical signal from receiver 302. Limiter 304 may include a pair of diodes for attenuating the noise in the electrical signal to a predetermined range, such as between about 0.3 and 0.8 volts. The electrical signal is then passed to amplifier 306 which may amplify the electrical signal to a predetermined voltage suitable of circuit logic, such as five volts. The electrical signal is then passed through a notch filter 308 to shunt noise at a predetermined frequency, such as 60 hertz which is a typical frequency for noise in an offshore application in the United States whereas a European application may have a 50 hertz notch filter. The electrical signal then enters a bandpass filter 310 to eliminate unwanted frequencies above and below the desired frequency and to recreate a signal having the original frequency, for example, two hertz.

The electrical signal is then fed through a phase lock loop 312 that is controlled by a precision clock 314 to assure that the electrical signal which passes through bandpass filter 310 has the proper frequency and is not simply noise. As the electrical signal will include a to certain amount of carrier frequency, phase lock loop 312 is able to verify that the received signal is, in fact, a signal carrying information to be retransmitted. The electrical signal then enters a series of shift registers that perform a variety of error checking features.

Sync check 316 reads, for example, the first six bits of the information carried in the electrical signal. These first six bits are compared with six bits that are stored in comparator 318 to determine whether the electrical signal is carrying the type of information intended for a subsea repeater such as subsea repeater 48 of FIG. 1. For example, the first six bits in the preamble to the information carried in electromagnetic wave fronts 46 must carry the code stored in comparator 318 in order for the electrical signal to pass through sync check 316.

If the first six bits in the preamble correspond with that in comparator 318, the electrical signal is shifted into a data register 320 which is in communication with a parity check 322 to analyze the information carried in the electrical signal for errors and to assure that noise has not infiltrated and abrogated the data stream by checking the parity of the data stream. If no errors are detected, the electrical signal is shifted into one or more storage registers 324. Storage registers 324 receive the entire sequence of information and may pass the electrical signal directly into power amplifier 328 for retransmission by transmitter 330 which may typically occur when subsea repeater 48 serves as a downlink. Alternatively, the information may be stored for a specified period of time determined by timer 326 prior to sending the signal to power amplifier 328. For example, subsea repeater 48 may be used to store formation information for a twelve or twenty-four hour period between transmissions to the surface.

Transmitter 330 may be an acoustic or an electromagnetic transmitter such as acoustic modem 54 or E-field probes 50 of subsea repeater 48 of FIG. 1. For example, transmitter 300 may transform the electrical signal into an electromagnetic signal, such as electromagnetic wave fronts 66, which are radiated into the earth when transmitter 300 is an electromagnetic transmitter. Alternatively, transmitter 300 may transform the electrical signal into acoustic waves 56 that are transmitted through the sea when transmitter 300 is an acoustic modem.

Even though FIG. 3 has described sync check 316, data register 320 and storage register 324 as shift registers, it should be apparent to those skilled in the art that alternate electronic devices may be used for error checking and storage including, but not limited to, random access memory, read only memory, erasable programmable read only memory and a microprocessor.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A subsea repeater apparatus for communicating information between surface equipment and downhole equipment that is disposed beneath a floor of a sea, the apparatus comprising:

an electromagnetic receiver inserted into the floor of the sea, the electromagnetic receiver receiving an electromagnetic signal carrying the information generated by the downhole equipment;

an acoustic transmitter acoustically retransmitting the information to the surface equipment through the sea; and an electronics package operably coupling the electromagnetic receiver and the acoustic transmitter.

2. The apparatus as recited in claim 1 wherein the electromagnetic receiver further comprises an H-field probe having an end that is inserted into the floor of the sea.

3. The apparatus as recited in claim 1 wherein the electromagnetic receiver further comprises at least one E-field probe having an end that is inserted into the floor of the sea.

4. The apparatus as recited in claim 1 wherein the electromagnetic receiver further comprises an H-field probe having an end that is inserted into the earth and at least one E-probe having an end that is inserted into the floor of the sea.

5. The apparatus as recited in claim 1 wherein the acoustic transmitter retransmits the information using multiple frequency shift keying.

6. The apparatus as recited in claim 1 wherein the electronics package further includes a storage device for storing the information.

7. The apparatus as recited in claim 1 wherein the electronics package processes the information.

8. The apparatus as recited in claim 1 wherein the acoustic transmitter retransmits the information using frequency shift keying.

9. A subsea repeater apparatus for communicating information between surface equipment and downhole equipment that is disposed beneath a floor of a sea, the apparatus comprising:

an acoustic receiver receiving an acoustic signal carrying information generated by the surface equipment through the sea;

an electromagnetic transmitter operably connected to the acoustic receiver, the electromagnetic transmitter inserted into the floor of the sea, the electromagnetic transmitter retransmitting the information to the downhole equipment by radiating electromagnetic waves into the floor of the sea; and an electronics package operably coupling the acoustic receiver and the electromagnetic transmitter.

10. The apparatus as recited in claim 9 wherein the electromagnetic transmitter further comprises at least one electrically conductive probe having an end that is inserted into the floor of the sea.

11. The apparatus as recited in claim 9 wherein the information in the acoustic signal is transmitted using frequency shift keying.

12. The apparatus as recited in claim 9 wherein the information in the acoustic signal is transmitted using multiple frequency shift keying.

13. The apparatus as recited in claim 9 wherein the electronics package processes the information.

14. The apparatus as recited in claim 9 wherein the electronics package further includes a storage device for storing information.

15. A method for communicating information between surface equipment and downhole equipment that is disposed beneath a floor of a sea, the method comprising the steps of:

receiving an acoustic signal transmitted through the sea carrying the information generated by the surface equipment with an acoustic receiver;

transforming the acoustic signal into an electrical signal carrying the information;

processing the information in the electrical signal in an electronics package;

transforming the electrical signal into an electromagnetic signal carrying the information; and electromagnetically retransmitting the information to the downhole equipment with an electromagnetic transmitter inserted into the floor of the sea.

16. The method as recited in claim 15 wherein the acoustic signal is transmitted using frequency shift keying.

17. The method as recited in claim 15 wherein the acoustic signal is transmitted using multiple frequency shift keying.

18. The method as recited in claim 15 further comprising the step of processing the information in the electrical signal in the electronics package.

19. The method as recited in claim 15 further comprising the step of storing the information into the electrical signal in the electronics package.

20. A subsea repeater apparatus for communicating information between surface equipment and downhole equipment that is disposed beneath a floor of a sea, the apparatus comprising:

an electromagnetic receiver including an H-field probe having an end that is inserted into the floor of the sea and at least one E-field probe having an end that is inserted into the floor of the sea, the electromagnetic receiver receiving an electromagnetic signal carrying the information generated by the downhole equipment and transforming the electromagnetic signal into an electrical signal;

an electronics package electrically connected to the electromagnetic receiver, the electronics package processing the electrical signal; and an acoustic transmitter electrically connected to the electronics package, the acoustic transmitter transforming the electrical signal into an acoustic signal and acoustically retransmitting the information to the surface equipment through the sea.

21. The apparatus as recited in claim 20 wherein the electronics package further includes a storage device for storing the information.

22. The apparatus as recited in claim 20 wherein the acoustic transmitter retransmits the information using frequency shift keying.

23. The apparatus as recited in claim 20 wherein the acoustic transmitter retransmits the information using multiple frequency shift keying.

24. A method for communicating information between surface equipment and downhole equipment that is disposed beneath a floor of a sea, the method comprising the steps of:

receiving an electromagnetic signal carrying the information generated by the downhole equipment with an electromagnetic receiver inserted into the floor of the sea;

transforming the electromagnetic signal into an electrical signal carrying the information;

processing the information in the electrical signal in an electronics package;

transforming the electrical signal into an acoustic signal carrying the information; and acoustically retransmitting the information to the surface through the sea with an acoustic transmitter.

25. The method as recited in claim 24 wherein the step of receiving an electromagnetic signal further comprises receiving the H-field component of the electromagnetic signal with an H-field probe having an end that is inserted into the floor of the sea.

26. The method as recited in claim 24 wherein the step of receiving an electromagnetic signal further comprises receiving the E-field component of the electromagnetic signal with at least one E-field probe having an end that is inserted into the floor of the sea.

27. The method as recited in claim 24 wherein the step of receiving an electromagnetic signal further comprises receiving the H-field component of the electromagnetic signal with an H-field probe having an end that is inserted into the floor of the sea and receiving the E-field component of the electromagnetic signal with at least one E-field probe having an end that is inserted into the floor of the sea.

28. The method as recited in claim 24 wherein the step of acoustically retransmitting the information further comprises using multiple frequency shift keying.

29. The method as recited in claim 24 further comprising the step of processing the information in the electrical signal in the electronics package.

30. The method as recited in claim 24 further comprising the step of storing the information in the electrical signal in the electronics package.

31. The method as recited in claim 24 wherein the step of acoustically retransmitting the information further comprises using frequency shift keying.

32. A method for communicating information between surface equipment and downhole equipment that is disposed beneath a floor of a sea, the method comprising the steps of:

receiving an electromagnetic signal carrying the information generated by the downhole equipment with an electromagnetic receiver including an H-field probe having an end that is inserted into the floor of the sea and at least one E-field probe having an end that is inserted into the floor of the sea;

transforming the electromagnetic signal into an electrical signal carrying the information;

processing the information in the electrical signal in an electronics package;

transforming the electrical signal into an acoustic signal carrying the information; and acoustically retransmitting the information to the surface equipment through the sea with an acoustic transmitter.

33. The method as recited in claim 32 further comprising the step of storing the information in the electrical signal in an electronics package.

34. The method as recited in claim 32 wherein the step of acoustically retransmitting the information further comprises using frequency shift keying.

35. The method as recited in claim 32 wherein the step of acoustically retransmitting the information further comprises using multiple frequency shift keying.

* * * * *